United States Patent [19]

Martin

[11] Patent Number: 4,823,448

[45] Date of Patent: Apr. 25, 1989

[54] CASKET COVER

[76] Inventor: Clarence G. Martin, Rt. 1, Box 255, Sulphur Springs, Ark. 72768

[21] Appl. No.: 911,730

[22] Filed: Sep. 26, 1986

[51] Int. Cl.[4] ..... A61G 17/00

[52] U.S. Cl. ..... 27/35; 27/2; 27/27

[58] Field of Search ..... 27/35, 32–34, 27/14, 16, 19, 28, 27, 12, 2

[56] References Cited

U.S. PATENT DOCUMENTS

| | | | |
|---|---|---|---|
| 270,620 | 1/1883 | Wilson | 27/32 X |
| 524,824 | 8/1894 | Hiser | 27/28 X |
| 1,065,579 | 6/1913 | Bentley | 27/35 |
| 1,292,268 | 1/1919 | De Camp | 27/27 |
| 2,167,001 | 7/1939 | Oppenheim | 27/35 |
| 3,050,818 | 8/1962 | Phillips | 27/35 |
| 3,654,676 | 4/1972 | McHugh | 27/2 |

*Primary Examiner*—Robert A. Hafer

*Attorney, Agent, or Firm*—Head & Johnson

[57] ABSTRACT

A casket system formed of a unitary casket cover having opposed sides, ends, a top and a open bottom, a coffin dimensioned to receive a human body therein and being further dimensioned to be received within the casket cover through the open bottom of the casket cover, and web members extending below the casket cover and attached to it for maintaining the coffin within the cover, the webs being releaseable so as to remove the casket cover from the coffin prior to depositing the coffin in a grave.

3 Claims, 1 Drawing Sheet

CASKET COVER

SUMMARY OF THE INVENTION

In recent years the cost of the traditional funeral has increased at a rapid rate and has become an economic burden on a high percent percentage of the population. One of the costs of a funeral is that of providing an impressive looking casket. In order to maintain tradition, people are required to purchase an expensive casket even though it is in public view for only a relatively short period of time and is thereafter buried in the earth, never to be seen again.

The present invention is directed towards means of providing a casket system which affords the beauty and dignity of an expensive casket, but which can save the family of the deceased a substantial amount of money. Others have provided casket systems intended to reduce the costs of caskets and for background information reference may be had to the following U.S. Pat. Nos: 3,815,185; 1,175,005; and 1,689,183. U.S. Pat. No. 3,815,185 shows a casket arrangement wherein external ornamented sides of the casket may be removed prior to burial. U.S. Pat. No. 1,175,005 shows a casket arrangement including a screen around the casket to conceal the actual configuration of the casket. U.S. Pat. No. 1,689,183 shows a casket having a covering means having the appearance of a day bed.

The present invention provides an improved casket system consisting of a casket cover, a coffin and a means for releaseably retaining the coffin within the casket cover. The unitary casket cover has opposed sides and ends, a top and an open bottom. The top preferably has a lid portion which can be opened such as for use in disclosing the upper torso and face of the deceased. The casket cover is preferably made of metal, wood or fiberglass so as to display a beautiful, aesthetically acceptable casket appearance befitting the dignity of the deceased.

The coffin can be made of wood or other inexpensive materials and be substantially unadorned. The coffin is positioned within the casket cover. More particularly, the casket cover is set over the coffin. The coffin preferably has a removable top cover or at least a portion of the top cover is removable so that in appropriate circumstances the upper body portion and the head of the deceased may be displayed when the lid of the casket cover is opened.

Extending below the casket cover are spaced apart web slings which support the coffin within the casket cover. The preferred means of securing the web slings to the casket cover includes the use of elongated handle rods extending along each side. The ends of the web slings are affixed to these handle rods, with the handle rods rotated to tighten the web slings.

After the use of the casket cover is concluded, such as after graveside ceremonies are finished and the funeral attendees have departed, the funeral home employees or others in charge of conducting the funeral and burial service, can release the web slings, such as by removing the handle rods. The casket cover can then be lifted off of the coffin, so that the coffin can then be lowered directly into a grave. In this way, the casket cover can be reused as many times as desired, to always present an aesthetically pleasing and dignified environment during the conduct of funerals and graveside services, but in an arrangement wherein the family of the deceased is required to purchase only a simpler and less expensive coffin for burial in the earth.

A better understanding of the invention will be had by reference to the following description and claims, taken in conjunction with the attached drawings.

DESCRIPTION OF THE PREFERRED EMBODIMENT

Figure 1:
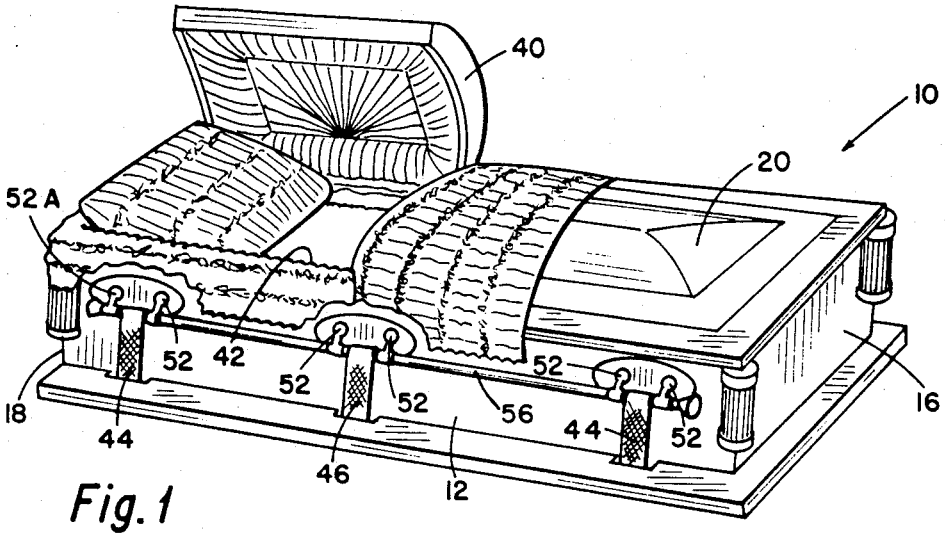
FIG. 1 is an isometric view of a casket system of this invention showing a casket cover with a portion of the top being in the form of a lid which is raised.
Figure 2:
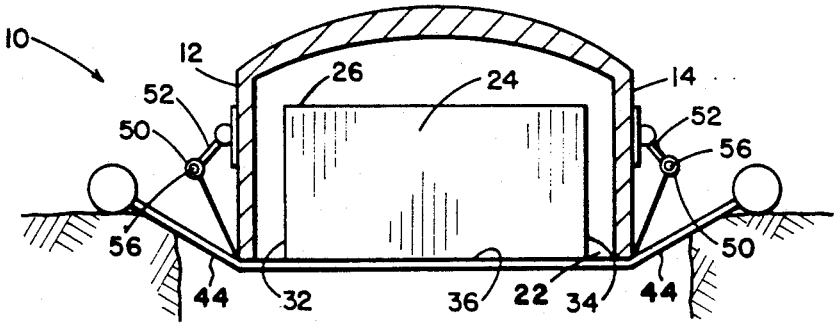
FIG. 2 is a cross-sectional view of the casket system of this invention with a coffin received within the casket cover and with the casket cover and coffin positioned directly over a grave as in position wherein graveside services are typically concluded.
Figure 3:
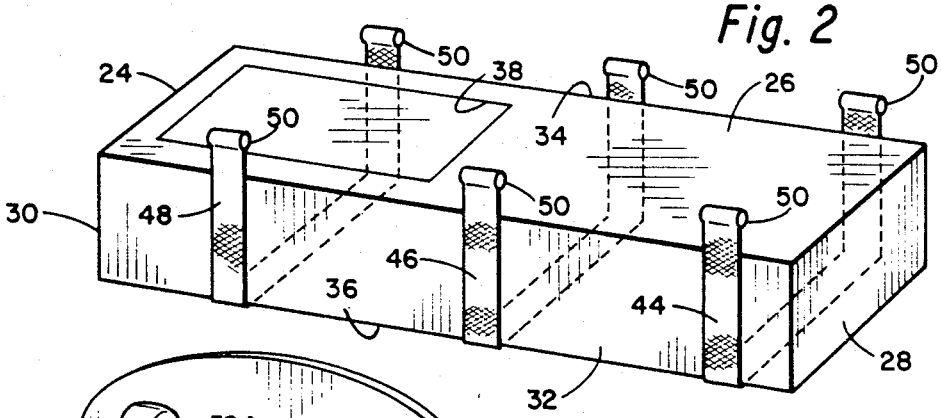
FIG. 3 is an isometric view of a coffin as used in this invention.

Referring to the drawings and first to FIGS. 1 and 2, a casket cover is generally indicated by the numeral 10. The casket cover includes opposed sides 12 and 14, ends 16 and 18, top 20 and an open bottom 22. The interior of the casket cover 10 is open to receive a coffin 24, configured such as in FIG. 3. The coffin 24 has a top 26, opposed ends 28 and 30, opposed sides 32 and 34 and a closed bottom 36. The coffin 24 may be made of wood, metal, plastic or fiberglass but can be constructed at substantially less expense than the casket cover and can be devoid of ornamentation. The coffin preferably is arranged so that the top 26 is removable or at least a portion of the top has a lid opening 38 therein which is closeable either by a sliding lid or by a completely removable lid which can be secured in place.

In like manner the casket cover 10 has a lid 40 providing, when in the opened position as shown in FIG. 1, a lid opening 42.

Extending below the casket cover 20 and below the coffin 24 when retained therein, are web slings 44, 46 and 48. While three web slings are shown, two, three, four or more may be employed however, in the typical case not more than three will normally be necessary. The web slings 44, 46, and 48 serve to retain the coffin 24 within the casket cover 20 and permit the casket cover to be moved about with the coffin therein.

Each of the web slings 44, 46 and 48 has a tubular member 50 at the upper end.

Figure 4:
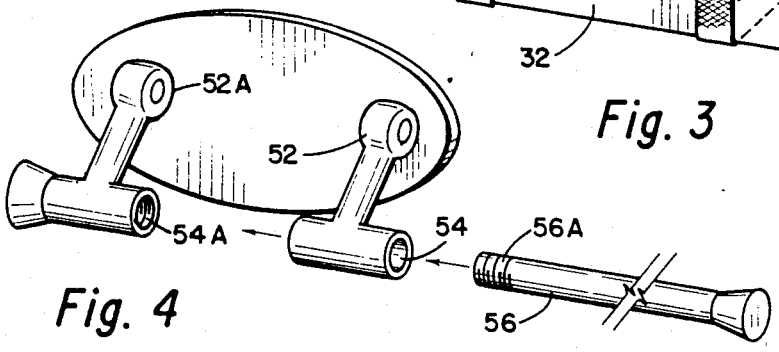
FIG. 4 is a detail of one means of removably securing a handle rod to the casket cover.

Affixed to each of the sides 12 and 14 of the casket cover are pivoted handles 52, arranged in adjacent pairs, there being one pair of pivoted handles 52 for each of the web slings 44, 46 and 48. There are at least two pairs of handles 52 on each side of the casket cover 20 (the drawings illustrate the arrangement having three pairs on each side). Each side of the casket has the same number of pairs of handles and the handles are equally spaced apart. The length of each tubular member 50 is less than the spacing between the outer ends of the handles 52. As shown best in FIG. 4, each of the handles 52 has at its outer end an opening 54 therethrough. The openings slideably receive an elongated handle rod 56, there being one handle rod 56 for each side 12 and 14 of the casket cover. In the preferred arrangement, such as shown specifically in FIG. 4, one end 56A of each of the handle rods is threaded and the end-most pivoted handle 52A has a recess 54A which is internally threaded.

DESCRIPTION OF USE OF THE CASKET SYSTEM

When the body of the deceased is prepared for a funeral it is positioned within the coffin 24. As previously indicated, the coffin 24 may be relatively inexpensive even though it may be amply sturdy and secure but it is not necessary to have elaborate decoration. If the upper portion and head of the deceased is to be publicly displayed, either at a funeral home, preceding a funeral or during a funeral, the lid opening 38 and casket lid 40 may be left open.

The casket cover 10 is then positioned over the coffin 24. Web slings 44, 46 and 48 are positioned beneath the coffin 24 and beneath the lower opening bottom 22 of the casket cover. The handle rods are removed and reinserted through the opening 54 in the outer ends of each pair of handles 52 and through the tubular members 50 positioned between the outer ends of each pair of handles 52. Each handle rod may then be rotated to thread the end 56A into the threaded opening 54A of the last most handle member.

The coffin then is secured within the casket cover. The casket cover lid 40 may be opened to permit the upper body portion and the head of the deceased to be viewed if desired.

The casket cover, with the coffin therein, can be on display during a funeral, after which the casket cover having the coffin therein can be transported by pallbearers in the usual manner to a hearse for transportation of the coffin to the burial site. At the burial site, where the grave has been prepared, the casket cover with the coffin therein is positioned on the usual cemetary equipment, by which the coffin is lowered into the grave following the graveside service. At the graveside service only the casket cover is seen.

After the graveside service is completed and the family and friends of the deceased have departed, the funeral employees can then remove the handle rods 56 from each side of the casket cover. This releases the web slings 44, 46 and 48. The casket cover can then be lifted upwardly off of the coffin, leaving the coffin positioned over the grave, as shown in FIG. 2. The coffin may then be lowered into the grave in the usual manner. The casket cover is then returned to the funeral home and may be used repeatedly. The attendees at the funeral service, including the attendees involved in the activities of transporting the coffin, never see the coffin 24. The attendees only see the casket cover which can be as beautifully ornamented as desired.

Since the handles 52 are pivoted, each time the casket cover 10 is lifted, the handles pivot upwardly, tightening the web slings 44, 46 and 48, thereby insuring the retention of the coffin 24 within the interior of the casket cover. In this manner, the coffin does not need to be secured in any other way to retain it within the casket cover. In addition, the system provides a very expeditious means of releasing the casket cover so that it can be removed from the coffin immediately prior to the interment of the coffin into the waiting grave.

What is claimed is:

1. A casket system comprising:

a unitary casket cover having opposed sides, opposed ends, an open bottom and a top closable by a hinged lid;

the casket cover having at least two pairs of handles extending from each of said opposed sides, the pairs of handles being of the same number on each said side of said casket cover and equally spaced apart from each other on each side and each handle having an outer end and an inner end, the inner end of each handle being affixed to a said casket cover side and the outer end having openings therethrough, the openings of the handles affixed to each casket cover side being in alignment;

a coffin having a bottom, a top, opposed sides and opposed ends and being dimensioned to receive a human body therein and to be received within said casket cover through said casket cover open bottom;

a plurality of web slings positioned below said coffin bottom and said casket cover open bottom, there being one web sling for each said pair of handles on a said side of said casket cover with each web sling having opposed ends;

a tubular member formed by each of said web sling's opposed ends, the length of each tubular member being less than the spacing between said outer ends of each handle and each tubular member being positioned between the outer ends of said handle with the opening in the tubular members being aligned with said openings in said handles; and a pair of elongated handle rods, there being one for each of said sides of said casket cover, each handle rod being received by said openings in each of said handles and being received by said tubular members positioned between the outer end of each handle whereby said web slings are retained in position below said casket cover and said coffin and said coffin is retained within said casket cover as long as said elongated handle rods are in place and whereby said handle rods may be slideably removed from said handles and said tubular members to permit said coffin to be removed from within said casket cover.

2. A casket system according to claim 2 wherein one end of each of said handle rods is threaded and wherein one of said handles affixed to each side of said casket cover is internally threaded, whereby said handle rod may be threadably and removably secured to said threaded handle member.

3. A casket system according to claim 1 wherein said handles are pivotally attached to said casket cover.

* * * * *